US006234916B1

(12) United States Patent
Carusillo et al.

(10) Patent No.: US 6,234,916 B1
(45) Date of Patent: May 22, 2001

(54) MULTI-TASK GOLF TOOL

(76) Inventors: Bruce E. Carusillo, 272 Good Hill Rd., Woodbury, CT (US) 06798; Thomas J. DeVito, 96 Ridgeview Rd., Southbury, CT (US) 06488

( * ) Notice: Subject to any disclaimer, the term of this patent is extended or adjusted under 35 U.S.C. 154(b) by 0 days.

(21) Appl. No.: 09/419,777

(22) Filed: Oct. 18, 1999

(51) Int. Cl.[7] ..... A63B 57/00
(52) U.S. Cl. ..... 473/286; 473/408
(58) Field of Search ..... D21/717, 718; 473/284, 286, 387–403

(56) References Cited

U.S. PATENT DOCUMENTS

| | | | | |
|---|---|---|---|---|
| D. 210,837 | * | 4/1968 | Warner | 473/402 |
| D. 246,803 | * | 12/1977 | Steinberg | D21/718 |
| 1,638,527 | * | 8/1927 | Clausing | 473/402 |
| 1,644,980 | * | 10/1927 | Clausing | 473/402 |
| 1,658,226 | * | 2/1928 | Clausing | 473/402 |
| 3,001,529 | * | 9/1961 | Watson | 473/387 |
| 4,063,731 | | 12/1977 | Kitay . | |
| 4,838,285 | * | 6/1989 | Petrone | 473/387 |
| 5,226,647 | * | 7/1993 | Notarmuzi | 473/284 |
| 5,292,120 | | 3/1994 | Pehoski et al. . | |
| 5,588,448 | * | 12/1996 | Photakis | 473/402 |
| 5,706,831 | | 1/1998 | Whitbeck . | |

OTHER PUBLICATIONS

"Golf Magazine", Dec. 1998, p. 99; Article about the "4–in–1 Golf Tool".

* cited by examiner

*Primary Examiner*—Steven Wong
(74) *Attorney, Agent, or Firm*—Raymond A. Nuzzo

(57) ABSTRACT

A multi-task golf tool comprising a body portion and a stem portion attached to the body portion. The body portion has a channel extending therethrough and which is sized for receiving a portion of a golf club. The body portion further includes a pair of walls wherein each wall is on a respective side of the channel and has a distal end. Each wall has a cut-out in the distal end thereof which is sized for receiving a portion of a smoking article. Each of the cut-outs has a perimetrical edge. The cut-outs are positioned directly opposite one another such that when a portion of a golf club is positioned within the channel and a smoking article is positioned within the cut-outs, the smoking article is transverse to the golf club. The stem portion has a distal end having a plurality of tines attached thereto. The golf tool further comprises a resilient member that has a first end attached to the perimetrical edge and is expandable within one of the cut-outs. The resilient member has a second end for contacting a smoking article. The golf tool further comprises a clip attached to the stem so as to allow the golf tool to be removably attached to other objects.

10 Claims, 3 Drawing Sheets

MULTI-TASK GOLF TOOL

BACKGROUND OF THE INVENTION

COPYRIGHT NOTICE

© Copyright 1999, Bruce Carusillo & Thomas Devito. All rights reserved.

A portion of the disclosure of this patent document contains material that is subject to copyright protection. The copyright owners have no objection to the facsimile reproduction by anyone of the patent document or the patent disclosure, as it appears in the USPTO patent file or records, but otherwise reserves all copyright rights whatsoever.

1. Field of the Invention

The present invention generally relates to multi-task golf tool that supports a golf club and smoking article simultaneously and which can be used to repair ball marks and divots and remove foreign particles from the face of a golf club and the cleats of golf shoes.

2. Description of Prior Art

In the past, it was common for golfers to lay their smoking article (i.e. cigar, cigarette, pipe, etc.) on the turf of a golf course while playing. However, placing the smoking article on the turf is no longer a desirable or safe option due to problems associated with wet grass, pesticides and fertilizers. Several prior art devices have been developed in attempt to address these problems. However, golfers do not want to be burdened with carrying and storing a plurality of pieces of equipment wherein each piece of equipment or tool is dedicated to just one task. What is needed is a golf tool that addresses the issue of supporting a smoking article but is also configured to perform other tasks as well, i.e. cleaning the faces of golf clubs, repairing ball marks or divots, supporting a golf club when not in use, and cleaning golf shoes cleats. It is further desired that the golf tool allow a golfer to rest his or her club and smoking article on the golf tool simultaneously thereby permitting the golfer to do other things, i.e. adjust shoe laces, clean golf balls, mark score cards, etc.

By way of example, the prior art discloses in U.S. Pat. No. 5,706,831 a golf tool that includes a ball mark repair tool for repairing ball marks in turf and a cigar support coupled to the ball mark repair tool for supporting a cigar such that neither end of the cigar is in contact with the turf. However, this device cannot also support a golf club simultaneously with the cigar.

U.S. Pat. No. 5,292,120 discloses a golf tool for golf equipment which combines various functions and features such as an oval ring for cleaning golf shoe cleats, a golf cleat tightener, a ball mark repair device, and a golf club shaft rest in a single unit. However, this device cannot support a smoking article such as a cigar, cigarette or pipe.

The December 1998 issue of *Golf Magazine* discloses a device referred to as the "Churchill Greenskeeper". This is a multi-task device that can support a cigar or a golf club, but not both simultaneously.

U.S. Pat. No. 5,143,371 discloses a golf aid with a ball mark repair tool, a means of allowing the attachment of a golfing glove, and structure for propping a grip of a golf club above the ground.

U.S. Pat. No. 4,273,329 discloses a flag pin attachment including a ball distance measuring line and turf repair tool.

U.S. Pat. No. 4,063,731 discloses a golf tool with a distance estimating facility which in turn provides automatic selection of a golf club, a ball mark repair tool and a cigarette holder. However, this device uses a triangular shaped opening wherein the cigarette is forcibly positioned between two perimetrical edges of the opening. Thus, it is very easy for the cigarette to become damaged. Furthermore, the cigarette, if not forcibly positioned as mentioned above, will most likely fall out of the opening since it would be extremely difficult for the cigarette to remain balanced on the perimetrical edge of the opening. Additionally, this device cannot support a larger smoking article such as a cigar or pipe.

In this respect, the golf tool of the present invention substantially departs from the conventional concepts and designs of the prior art, and in so doing provides a multi-task golf tool that can be:

1) inserted into the ground and which can support a smoking article, such as a cigar, pipe, or cigarette, and a portion of a golf club simultaneously without damaging the smoking article but yet, significantly decreasing the probability of the smoking article from becoming dislodged and falling on the turf;
2) used to repair ball marks or divots;
3) used to clean the grooved golf club faces; and
4) used to clean golf shoe cleats.

SUMMARY OF THE INVENTION

The present invention is directed a multi-task golf tool comprising:

(a) a body portion having a channel extending therethrough and sized for receiving a portion of a golf club, the body portion further including a pair of walls, each wall being on a respective side of the channel and having a distal end, each wall having a cut-out in the distal end thereof which is sized for receiving a portion of a smoking article, each of the cut-outs having a perimetrical edge, the cut-outs being positioned directly opposite one another such that when a portion of a golf club is positioned within the channel and a smoking article is positioned within the cut-outs, the smoking article is transverse to the golf club;

(b) a stem portion attached to the body portion, the stem portion having a distal end having a plurality of tines attached thereto;

(c) a resilient member having a first end attached to the perimetrical edge and being expandable within one of the cut-outs and a second end for contacting a smoking article; and (d) a clip attached to the stem so as to allow the golf tool to be removably attached to other objects.

BRIEF DESCRIPTION OF THE DRAWINGS

The features of the invention are believed to be novel. The figures are for illustration purposes only and are not drawn to scale. The invention itself, however, both as to organization and method of operation, may best be understood by reference to the detailed description which follows taken in conjunction with the accompanying drawings in which.

DETAILED DESCRIPTION OF THE INVENTION

In describing the preferred embodiments of the present invention, reference will be made herein to FIGS. 1–5 of the drawings in which like numerals refer to like features of the invention.

Figure 1:
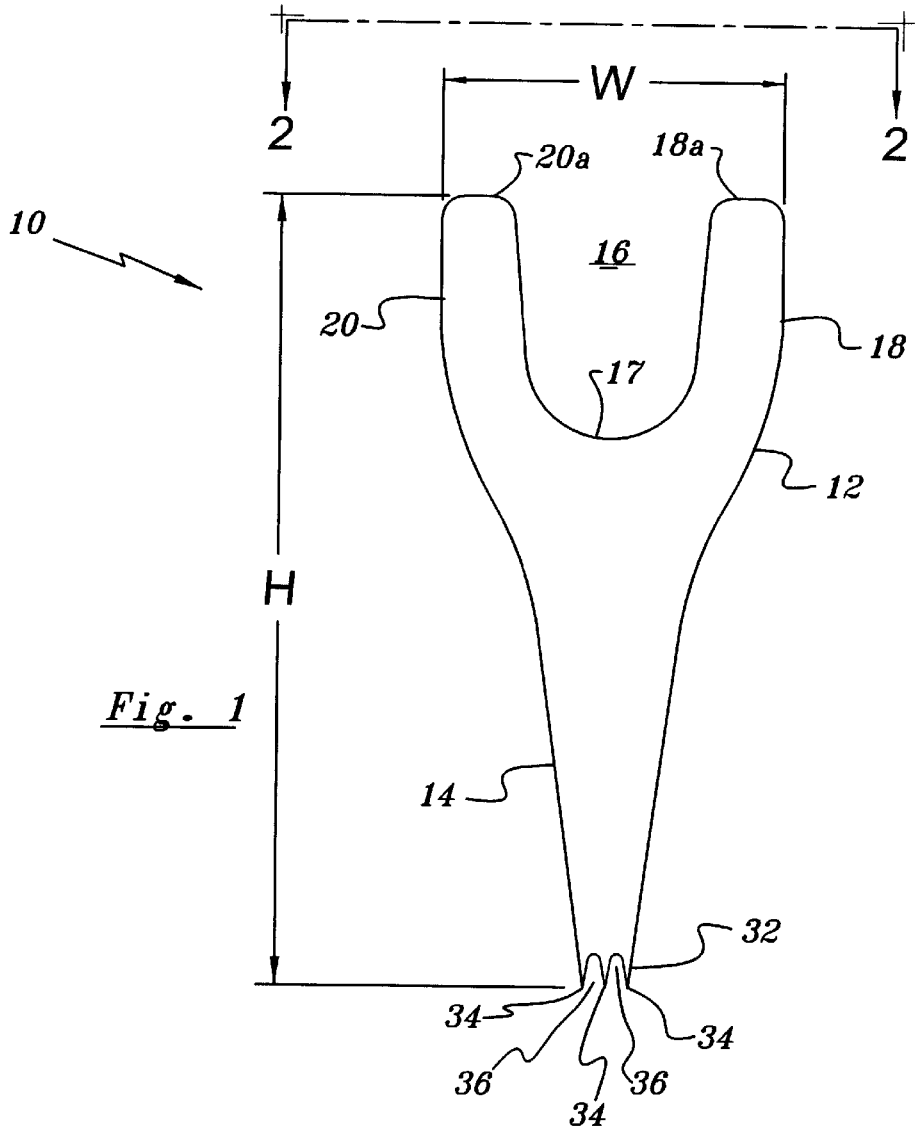
FIG. 1 is a side elevational view of the golf tool of the present invention.
Figure 2:
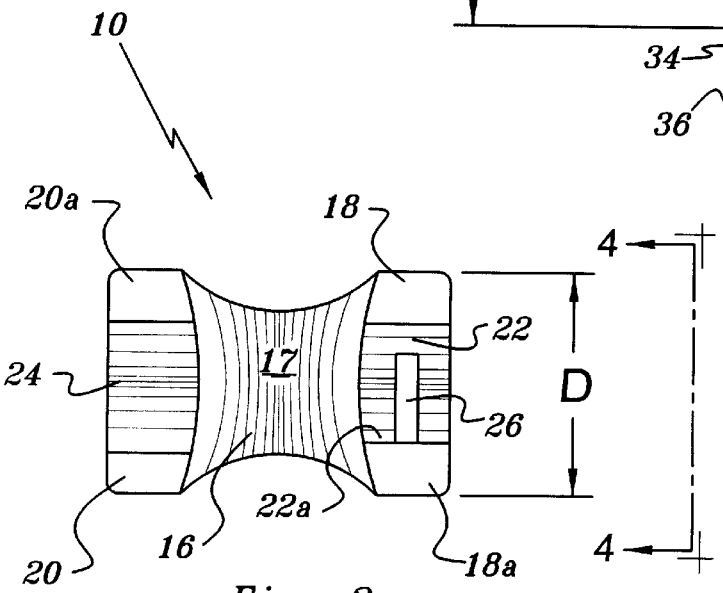
FIG. 2 is a top plan view taken along line 2—2 of FIG. 1.
Figure 3:
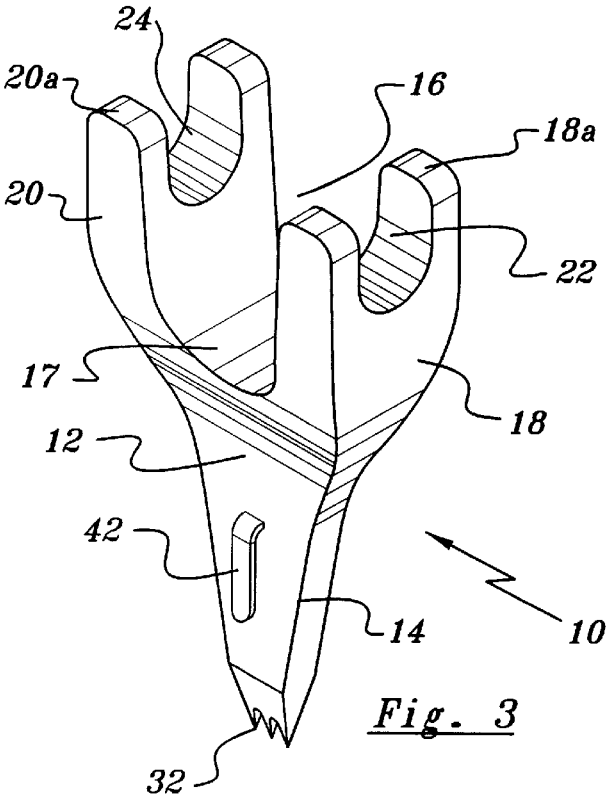
FIG. 3 is a perspective view of the golf tool of the present invention.

Referring to FIGS. 1–3, golf tool 10 comprises body portion 12 and stem portion 14 that is attached to body portion 12. Body portion 12 has channel 16 which is sized for receiving a portion of a golf club, i.e. a golf club handle. In one embodiment, channel 16 is generally "U" shaped. In another embodiment, channel 16 is generally "V" shaped. In yet another embodiment, channel 16 is generally semi-circular in shape. Channel 16 has a bottom surface 17 which receives a portion of the golf club. In a preferred embodiment, surface 17 is substantially smooth. Body portion 12 further includes wall portions 18 and 20. Each wall portion 18 and 20 is on a respective side of channel 16 and extends to distal ends 18*a* and 20*a*, respectively.

Referring to FIGS. 2 and 3, wall portion 18 has cut-out 22. Similarly, wall portion 20 has cut-out 24. In one embodiment, cut-outs 22 and 24 are substantially aligned with one another. In one embodiment, cut-outs 22 and 24 are generally "U" shaped. In another embodiment, cut-outs 22 and 24 are generally "V" shaped. In yet another embodiment, cut-outs 22 and 24 are generally semi-circular in shape. Cut-outs 22 and 24 are sized to receive a smoking article. As used herein, the term "smoking" article is defined to be a cigar, pipe or cigarette.

Figure 4:
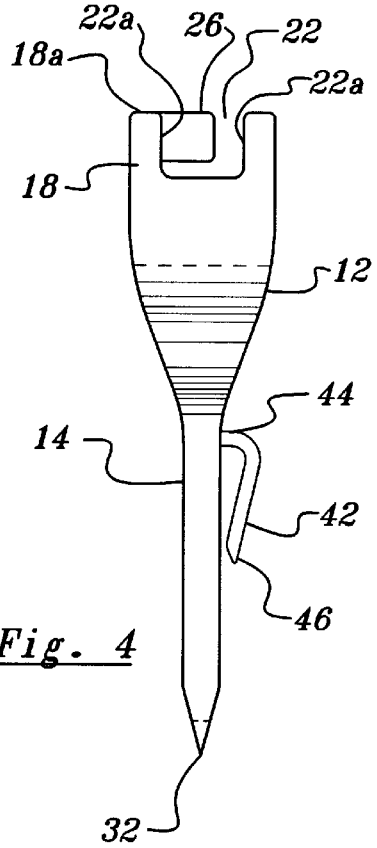
FIG. 4 is a view taken along line 4—4 of FIG. 2.
Figure 4A:
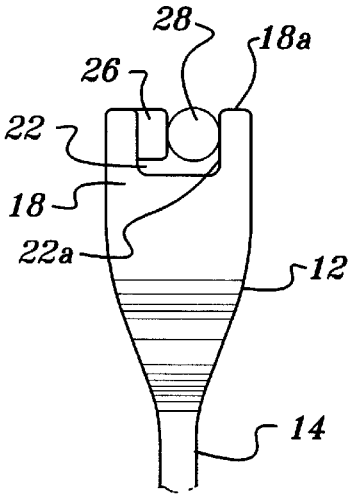
FIG. 4A is a view, similar to FIG. 4, that shows a cigar supported by the golf tool of the present invention.

Referring to FIGS. 2 and 4, perimetrical edge 22*a* results from the formation of cut-out 22. Golf tool 10 further comprises resilient member 26 that is attached to perimetrical edge 22*a*. In one embodiment, resilient member 26 is fabricated from resilient foam. However, other resilient materials could be used as well. Resilient member 26 allows smoking articles of differing diameters to be secured within cut-outs 22 and 24. For example, if a cigar is placed within cut-outs 22 and 24, resilient member 26 would be compressed thereby exerting a slight force upon the cigar so as to secure the cigar within cut-out 22. This is illustrated in FIG. 4A. Cigar 28 is snug between resilient member 26 and perimetrical edge 22*a*. The resiliency of resilient member 26 prevents damage to the smoking article. In a preferred embodiment, wall portions 18 and 20 have a predetermined thickness such that perimetrical edge 22*a* is not sharp. This feature further prevents damage to the smoking article.

Figure 4B:
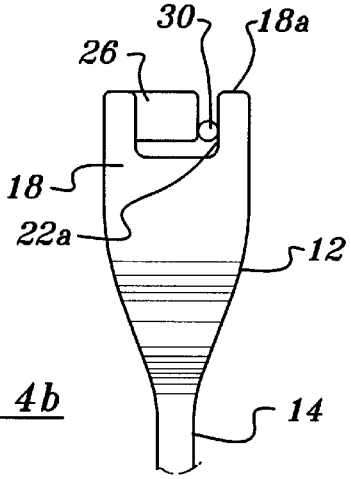
FIG. 4B is a view, similar to FIG. 4A, that shows a cigarette supported by the golf tool of the present invention.

If cigar 28 is replaced by a cigarette, which has a relatively smaller diameter than a cigar, flexible member 26 would expand outward and press the cigarette against perimetrical edge 22*a*. This is illustrated in FIG. 4B. Cigarette 30 is snug between resilient member 26 and perimetrical edge 22*a*. Thus, resilient member 26 prevents the smoking article from being dislodged from cut-outs 22 and 24. In an alternate embodiment, golf tool 10 utilizes an additional flexible members (the same as flexible member 26) in cut-out 24. In a further embodiment, golf tool 10 does not utilize flexible member 26.

Figure 5:
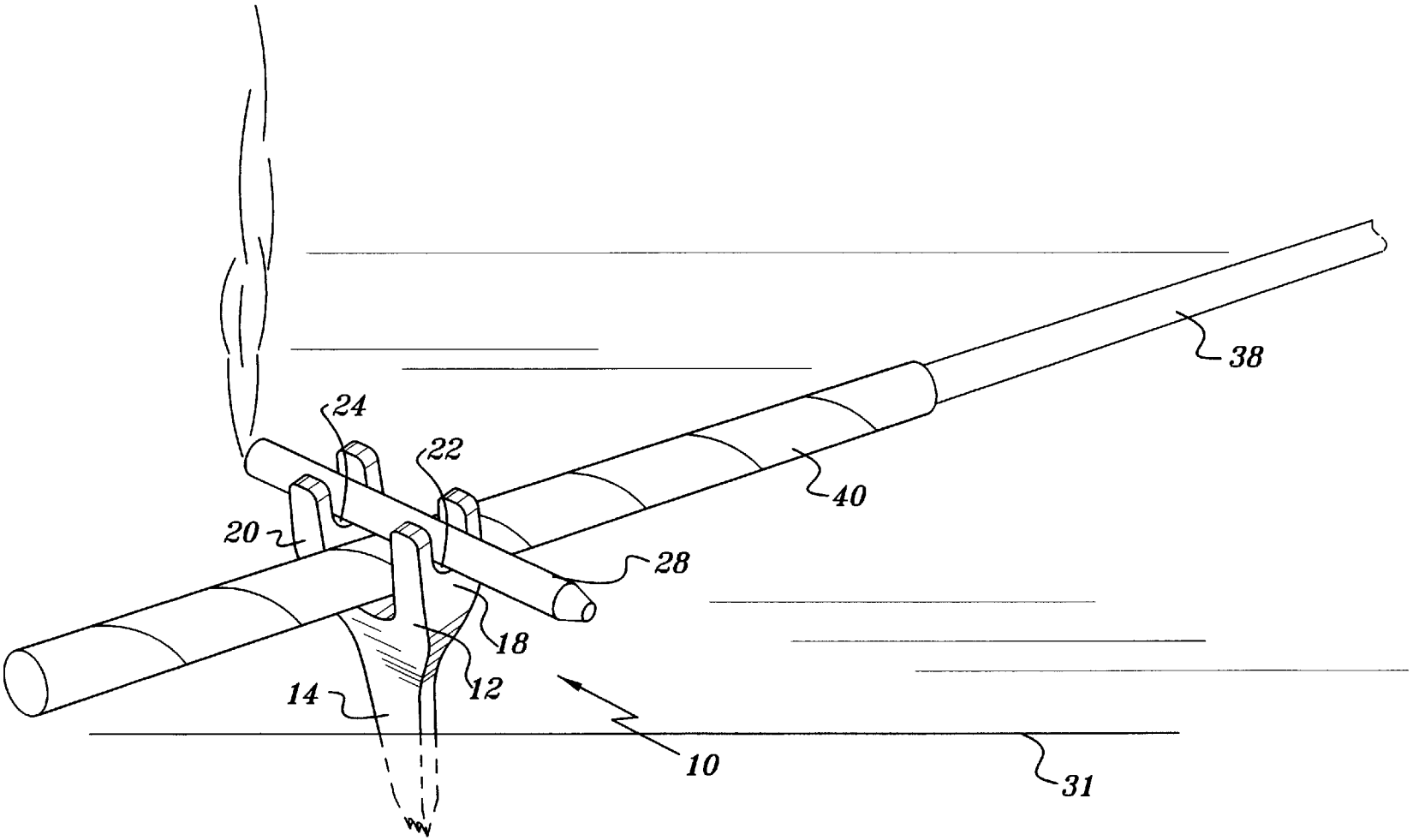
FIG. 5 is a perspective view illustrating how the golf club of the present invention can support a smoking article and a portion of a golf club simultaneously.

Referring to FIG. 5, there is shown golf tool 10 supporting a cigar and a portion of a golf club. Stem 14 (which is partially shown in phantom) is inserted into ground 31. Specifically, cigar 28 positioned within cut-outs 22 and 24. Golf club 38 (which is only partially shown) has grip 40 that is positioned within channel 16. The position of cut-outs 22 and 24 with respect to channel 16 results in the smoking article being transverse to the axis of golf club 38.

Referring to FIGS. 1, 3 and 4, stem portion 14 extends to a distal end 32. End 32 is configured for: (i) insertion into the ground, (ii) repair of ball marks and divots, (iii) cleaning of grooves of golf club face, (iv) removing soil or other particles from the bottom of golf shoes. Distal ends 32 comprises a plurality of tines 34. Tines 34 facilitate removal from particles, e.g. soil, dirt, turf, etc. from the grooves of golf club faces. In a preferred embodiment, stem portion 14 is tapered in the direction of distal end 32. The tapered configuration allows distal end 32 to be used to repair ball marks and divots as well as removing soil from golf shoe cleats.

Referring to FIG. 4, golf tool 10 further includes clip 42 that allows golf tool 10 to be removably attached to a golf bag or the player's (or user's) belt. Clip 42 comprises base portion 44, which is attached to stem portion 14, and extended portion 46.

An important feature of golf tool 10 is the use of cut-outs 22 and 24 to support the smoking article. This configuration substantially reduces the probability of the smoking article becoming dislodged. Another important feature of golf tool 10 is that surface 17 of channel 16 is substantially smooth with no sharp edges that can damage the grip of the golf club.

Referring to FIGS. 1 and 2, golf tool 10 has a predetermined height H, a predetermined width W and predetermined depth D. In one embodiment, height H is about 4.5 inches, width W is about 2.0 inches, and depth D is about 1.25 inches.

Golf tool 10 can be fabricated from a variety of materials, e.g. metal, plastic, etc. However, in a preferred embodiment, golf tool 10 is fabricated from steel. In another embodiment, golf tool 10 is fabricated from steel and plated with copper, nickel or chrome or other suitable quality finishes to provide a high quality product that is durable, shiny and easy to clean. In a further embodiment, golf tool 10 is fabricated from stainless steel.

Thus, golf tool 10 of the present invention:

a) solves the aforementioned problems discussed above that relate to the prior art devices;

b) supports a smoking article and a portion of a golf club simultaneously and in such a manner that the probability of the smoking article being dislodged is significantly reduced;

c) can be used to perform other tasks such as cleaning golf club faces and golf shoe cleats;

d) can be used to repair ball marks and divots e) is easy to use and store when not in use; and f) can be manufactured at reasonable costs.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. A multi-task golf tool comprising:

a body portion having a channel extending therethrough and sized for receiving a portion of a golf club, the body portion further including a pair of walls, each wall being on a respective side of the channel and having a distal end, each wall having a cut-out in the distal end thereof which is sized for receiving a portion of a smoking article, each of the cut-outs having a perimetrical edge;

a resilient member having a first end attached to the perimetrical edge of one of the cut-outs and a second end for contacting a smoking article; and a stem portion attached to the body portion, the stem portion having a distal end having at least one tine attached thereto.

2. The golf tool according to claim 1 wherein the cut-outs are positioned directly opposite one another such that when a portion of a golf club is positioned within the channel and a smoking article is positioned within the cut-outs of the wall portions, the smoking article is transverse to the golf club.

3. The golf tool according to claim 1 further comprising a clip attached to the stem portion for removably attaching the golf tool to other objects when the golf tool is not in use.

4. The multi-task golf tool according to claim 1 wherein the resilient member is expandable within the cut-out.

5. The golf tool according to claim 1 wherein the channel is generally "U" shaped.

6. The golf tool according to claim 1 wherein each of the cut-outs is generally "U" shaped.

7. The golf tool according to claim 1 wherein the body and stem portions are fabricated from steel.

8. The golf tool according to claim 1 wherein the resilient member is fabricated from foam.

9. A multi-task golf tool comprising:

a body portion having a channel extending therethrough and sized for receiving a portion of a golf club, the body portion further including a pair of walls, each wall being on a respective side of the channel and having a distal end, each wall having a cut-out in the distal end thereof which is sized for receiving a portion of a smoking article, each of the cut-outs having a perimetrical edge, the cut-outs being positioned directly opposite one another such that when a portion of a golf club is positioned within the channel and a smoking article is positioned within the cut-outs, the axis of the smoking article is transverse to the axis of the golf club;

a stem portion attached to the body portion, the stem portion having a distal end having a plurality of tines attached thereto;

a resilient member having a first end attached to the perimetrical edge and being expandable within one of the cut-outs and a second end for contacting a smoking article; and a clip attached to the stem so as to allow the golf tool to be removably attached to other objects.

10. A multi-task golf tool comprising:

a body portion having a channel extending therethrough and sized for receiving a portion of a golf club, the body portion further including a pair of walls, each wall being on a respective side of the channel and having a distal end, each wall having a cut-out in the distal end thereof which is sized for receiving a portion of a smoking article, the cut-outs being positioned directly opposite one another and positioned in the walls such that when a portion of a golf club is positioned within the channel and a smoking article is positioned within the cut-outs, the smoking article is generally transverse to and positioned above the portion of the golf club that is positioned within the channel; and a stem portion attached to the body portion, the stem portion having a distal end having at least one tine attached thereto.

* * * * *